US005338151A

United States Patent [19]

Kemmner et al.

[11] Patent Number: 5,338,151

[45] Date of Patent: Aug. 16, 1994

[54] UNIT FOR DELIVERING FUEL FROM THE FUEL TANK TO THE INTERNAL COMBUSTION ENGINE OF A MOTOR VEHICLE

[75] Inventors: Ulrich Kemmner, Stuttgart; Kurt Frank, Schorndorf-Haubersbronn; Michael Niederkofler, Remseck, all of Fed. Rep. of Germany

[73] Assignee: Robert Bosch GmbH, Stuttgart, Fed. Rep. of Germany

[21] Appl. No.: 956,894

[22] PCT Filed: May 27, 1991

[86] PCT No.: PCT/DE91/00449

§ 371 Date: Dec. 28, 1992

§ 102(e) Date: Dec. 28, 1992

[87] PCT Pub. No.: WO92/00449

PCT Pub. Date: Jan. 9, 1992

[30] Foreign Application Priority Data

Jun. 28, 1990 [DE] Fed. Rep. of Germany ..... 4020520

[51] Int. Cl.[5] ..... F01D 1/12; F04B 17/00

[52] U.S. Cl. ..... 415/55.1; 417/423.14; 417/DIG. 1; 417/423.3

[58] Field of Search ..... 417/423.3, 423.14, 423.1, 417/DIG. 1; 415/55.1; 123/495, 516

[56] References Cited

U.S. PATENT DOCUMENTS

| | | | |
|---|---|---|---|
| 2,369,440 | 2/1945 | Curtis | 417/423.3 |
| 3,128,710 | 4/1964 | Blomgren | 417/DIG. 1 |
| 4,462,761 | 7/1984 | Ringwald | 415/55.1 |
| 4,508,492 | 4/1985 | Kusakawa | 415/55.1 |
| 4,591,311 | 5/1986 | Matsuda et al. . | |
| 4,692,092 | 9/1987 | Matsuda | 415/55.1 |
| 4,784,587 | 11/1988 | Takei | 417/423.1 |
| 4,793,766 | 12/1988 | Kumata . | |
| 4,854,830 | 8/1989 | Kozawa | 417/423.1 |
| 5,024,578 | 6/1991 | Vansadia | 415/55.1 |
| 5,192,184 | 3/1993 | Nobuo | 415/55.1 |

FOREIGN PATENT DOCUMENTS

| | | | |
|---|---|---|---|
| 422800 | 4/1991 | European Pat. Off. . | |
| 3509374 | 9/1986 | Fed. Rep. of Germany . | |
| 0079193 | 5/1985 | Japan | 415/55.1 |
| 0175297 | 8/1986 | Japan | 415/55.1 |
| 0263293 | 10/1988 | Japan | 417/423.3 |
| 2134598 | 8/1984 | United Kingdom . | |

*Primary Examiner*—Carl S. Miller
*Attorney, Agent, or Firm*—Michael J. Striker

[57] ABSTRACT

A unit for delivery of fuel from the fuel tank to the internal combustion engine of a motor vehicle includes a feed pump which is arranged in the fuel tank and constructed as a flow pump with substantially circular-cylindrical impeller driven in rotation in a correspondingly circular-cylindrical pump chamber. In at least one of the two chamber end walls, at least one approximately annular delivery duct which is groove-like in cross section extends from a suction opening which opens into the pump chamber to a pressure opening leading out of the latter. This end wall of the chamber is penetrated in the region of the pressure opening by a bore hole connecting the pump chamber with a region of the system in which low pressure prevails. Gas bubbles can be removed from the pump and accordingly from the delivery path in a particularly reliable and simple manner in that this bore hole is situated in a sealing surface which defines the delivery duct in the radial direction with reference to the axis of rotation of the impeller.

9 Claims, 1 Drawing Sheet

UNIT FOR DELIVERING FUEL FROM THE FUEL TANK TO THE INTERNAL COMBUSTION ENGINE OF A MOTOR VEHICLE

BACKGROUND OF THE INVENTION

The present invention relates to a unit for delivering fuel from a fuel tank to the internal combustion engine of a motor vehicle.

More particularly, it relates to a unit of the above mentioned general type which has a feed pump arranged in a fuel tank and constructed as a flow pump with a substantially circular-cylindrical impeller rotating in a circular-cylindrical pump chamber.

Units of the above mentioned general type are known in the art. A feed unit is already known (DE-OS 35 09 374) in which this bore hole is arranged directly in the delivery duct and provided with a resilient valve flap which remains in its open position while gas is being conveyed, but when fuel is delivered is deformed against spring force by the more "viscous" medium and closes the opening of the bore hole on the duct side. However, such a construction requires a particularly costly assembly of the valve flap. There is also the risk that the open valve flap will scrape against the impeller of the feed pump when gas is conveyed causing unwanted noise and will finally be destroyed.

SUMMARY OF THE INVENTION

Accordingly, it is an object of the present invention to provide a unit for delivering fuel from a fuel tank to an internal combustion engine, which avoids the disadvantages of the prior art.

In keeping with these objects and with others which will become apparent hereinafter, one feature of the present invention resides, briefly stated, in a unit in which an end wall of the pump chamber is penetrated in the region of a pressure opening by a bore hole which connects the pump chamber with a region of the system with a low pressure, and the bore hole in accordance with the present invention is located in a sealing surface which defines a delivery duct in a radial direction with reference to an axis of rotation of the impeller.

When the unit is designed in accordance with the present invention, it has the advantage over the prior art that there are no movable structural members which are subject to wear during operation. It is also unnecessary to assemble such parts.

In a particularly advantageous construction of the feed unit, the blade edge has a first and second ring of blades, the second blade ring having a greater radius than the first blade ring, and two delivery ducts associated with the respective blade ring are located in the end wall of the chamber. The inner delivery duct is connected with the outer delivery duct via an intermediate duct. The suction opening is arranged at the inner delivery duct, while the pressure opening is arranged at the outer delivery duct. The bore hole is located in a region of the sealing surface which extends at least substantially between the two delivery ducts.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
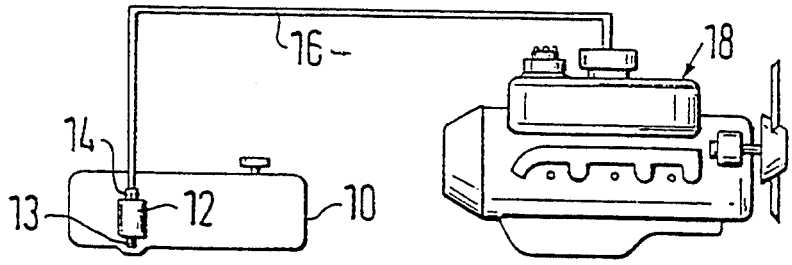
FIG. 1 shows a schematic view of an arrangement with a fuel supply tank, a fuel feed unit, and an internal combustion engine of a motor vehicle.
Figure 2:
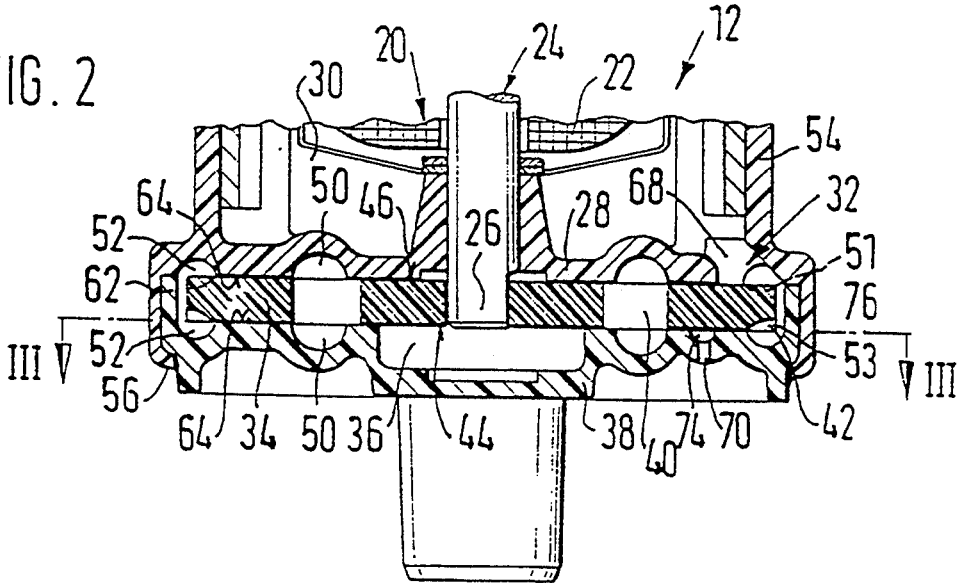
FIG. 2 is an enlarged view of a partial longitudinal section through the feed unit according to FIG. 1 along line II—II in FIG. 3.
Figure 3:
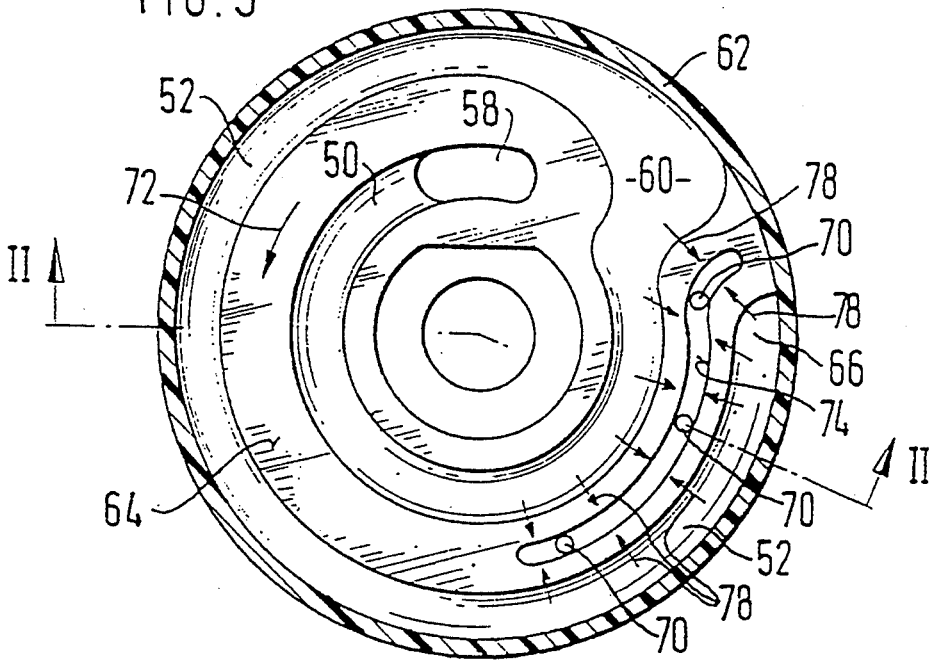
FIG. 3 shows a section through a pump chamber cover on the suction opening side belonging to the feed unit according to FIG. 2 along line III—III.

FIG. 1 shows a fuel tank 10 in which a fuel feed unit 12 is arranged. A pressure line 16 leading to an internal combustion engine 18 is connected to a pressure sleeve 14 of the fuel feed unit 12. During operation of the internal combustion engine 18, the fuel feed unit 12 sucks fuel out of the fuel tank 10 via a suction sleeve 13 and delivers the fuel to the internal combustion engine 18. The fuel feed unit 12 is outfitted with an electric drive motor 20 (FIG. 2) whose motor armature 22 sits on an armature shaft 24. One end 26 of the armature shaft 24 penetrates a dividing wall 28 which divides a space 30 containing the electric motor 20 from a feed pump 32. The feed pump 32 is constructed as a stream or flow pump. Its impeller 34 is connected with the end 26 of the armature shaft 24 so as to be fixed with respect to rotation relative to it. The impeller 34 is arranged in a pump chamber 36 which is defined toward the drive motor 20 by the dividing wall 28 on one side and on the other side by a cover 38 in which the suction sleeve 13 is located. In the embodiment example the feed pump is constructed as a two-stage flow pump. However, this has no importance with respect to the present invention since the invention can also easily be applied in a single-stage flow pump. The impeller 34 which has an inner, first ring 40 of blades rotates in the pump chamber 36. The impeller 34 has a second ring 42 of blades in its peripheral area. The second ring 42 includes two partial rings, each of which is constructed on one of the two end faces 44, 46 of the impeller 34 which has a substantially circular-cylindrical shape. The two partial blade rings of the second blade ring 42 are provided with reference numbers 51 and 53 in FIG. 2. The dividing wall 28 is securely connected with a housing part 54 enclosing the feed unit 12. The pump chamber 36 is closed by the cover 38 on the side of the impeller 34 remote of the dividing wall 28. This cover 38 is held in its receptacle by an inwardly shaped edge 56 of the housing part 54. As shown in FIG. 3, a first or inner delivery duct 50 extends in the counterclockwise direction from a suction opening 58 located in the suction sleeve 13 to an intermediate duct 60 extending in a substantially radial direction. A second or outer delivery duct 52 is connected to the intermediate duct 60. This delivery duct 52 extends along an edge shoulder 62 of the cover 38 into the vicinity of the intermediate duct 60. Corresponding delivery ducts 50, 52 are also arranged in the dividing wall 28. As seen in the radial direction, the two delivery ducts 50 and 52 are situated at a distance from one another so that a dividing surface 64 remains between them. Since the two delivery ducts 50 and the two delivery ducts 52 are situated opposite each other as seen in the axial direction, the dividing surfaces 64 of the dividing wall 28 and of the cover 38 are also situated opposite each other. In the terminating region 66 of the delivery duct 52 in the cover, 38 a pressure opening 68 is situated opposite the latter in the dividing wall 28 and connects the delivery duct 52 with the space 30 which, as shown in FIG. 1, contains the pressure sleeve 14. FIG. 3 further shows that three bore holes 70 are arranged in the dividing surface 64 of the cover 48 and lead from the pump chamber 36 to the suction side of the pump 32. These bore holes 70 thus connect the pump chamber with a region of the system in which low pressure prevails. In the embodiment example this region is the interior of the tank. These three gas-discharge bore holes 70 are arranged one after the other, as seen in the rotating direction (arrow 72) of the rotor 34, in a trough-like groove 74 extending in the rotating direction shown by the arrow 72 between the two delivery ducts 50 and 52. The two delivery ducts 50 and 52 thus extend from the suction opening 58 to the pressure opening 68. The cover 38 contains the suction opening 58 and the dividing wall 28 contains the pressure opening 68. The hydraulic connection between the identical delivery ducts situated opposite one another in the axial direction is effected by the openings between the blades of the first ring 40 and by an annular gap 76 remaining between the edge shoulder 62 and the outer surface area of the impeller 34. With the understanding that the invention can also be realized with only one bore hole 70 and that this single bore hole is the central bore hole shown in FIG. 3, the configuration of the trough-like groove 74 can also become apparent in that a portion of the groove 74 extends in the circumferential direction (arrow 72) and another portion of the groove 74 extends opposite this circumferential direction of the impeller 34. The two walls 28 and 38 defining the pump chamber 36 in the axial direction of the rotor 34 are produced from plastic in the embodiment example. The trough-like groove 74 is molded into the cover 38.

The feed unit according to the invention operates in the following manner:

When the impeller 34 is driven by the electric motor 20 the feed pump 32 sucks fuel out of the fuel tank 10 via the suction opening 58 and presses it in the direction of arrow 72 through the first delivery duct 50 and through the intermediate duct 60 into the outer delivery duct 52, from which the fuel enters the space 30 of the drive motor 20 via the pressure opening 68 and exits via the pressure sleeve 14. There are slight radial gaps between the two end faces of the impeller 34 and the walls 38, 28 facing the latter. Gas bubbles present in the delivery duct 50, 60, 52 are pressed out of the delivery ducts in the direction of the arrow 78 via these radial gaps and are received by the trough-like groove 74. From there, the gas bubbles leave the pump chamber 36 via the bore holes 70. The gas bubbles in question are formed, for instance, by cavitation occurring in certain regions of the feed pump. Such gas bubbles can also occur if the pump has been completely empty and the feed pump first delivers this air. In any event, gas bubbles must be prevented from remaining in the system, reaching the internal combustion engine 18 via the pressure line 16 and disturbing operation of the latter.

It will be understood that each of the elements described above, or two or more together, may also find a useful application in other types of constructions differing from the types described above.

While the invention has been illustrated and described as embodied in a unit for delivering fuel from the fuel tank to the internal combustion engine of a motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A unit for delivering fuel from a fuel tank to an internal combustion engine of a motor vehicle, comprising a flow pump having a plurality of walls forming a pump chamber and including two end walls in at least one of which end walls a delivery duct is formed, said at least one end wall having a bore hole which connects said pump chamber with a low pressure region, said pump further having an impeller which rotates in said pump chamber about an axis of rotation; means forming a suction opening which opens into said pump chamber and from which said delivery duct extends, and a pressure opening leading out of said pump chamber, said one end wall having a sealing surface which defines inner and outer limits of said delivery duct in a radial direction with respect to said axis of rotation of said impeller, said bore hole being located in said sealing surface, said sealing surface having a trough-like groove proceeding from said bore hole and having one groove part extending in a rotation direction and another part extending opposite to the rotation direction of said impeller.

2. A unit as defined in claim 1, wherein said impeller is substantially circular-cylindrical, said pump chamber being correspondingly circular-cylindrical, said delivery duct being annular.

3. A unit as defined in claim 1, wherein said trough-like groove has additional bore holes.

4. A unit as defined in claim 1, wherein said impeller has a first blade ring and a second blade ring formed so that said second blade ring has a greater radius than said first blade ring, said at least one end wall of said chamber having another delivery duct, said delivery ducts being associated with said blade rings and including an inner delivery duct and an outer delivery duct connected with one another via an intermediate duct, said suction opening being arranged at said inner delivery duct, while said pressure opening is arranged at said outer delivery duct, said sealing surface in which said bore hole is located extending at least substantially between said two delivery ducts.

5. A unit as defined in claim 9, wherein said impeller has a first blade ring and a second blade ring formed so that said second blade ring has a greater radius than said first blade ring, said at least one end wall of said chamber having another delivery duct, said delivery ducts being associated with said blade rings and including an inner delivery duct and an outer delivery duct connected with one another via n intermediate duct, said suction opening being arranged at said inner delivery duct, while said pressure opening is arranged at said outer delivery duct, said sealing surface in which said bore hole is located extending at least substantially between said two delivery ducts, said trough-like duct extending in a radial direction between said two delivery ducts until a region of said intermediate duct.

6. A unit as defined in claim 1, wherein said at least one wall of said chamber is formed as a cover composed of a plastic material.

7. A unit as defined in claim 1, wherein said at least one wall of said chamber is composed of an injection molded plastic material.

8. A unit as defined in claim 9, wherein said at least one end wall is formed as a cover in which said trough-like groove is formed.

9. A unit as defined in claim 1; and further comprising a fuel tank from which said feed pump delivers fuel, said fuel tank enclosing a space, said pump chamber having a region of higher pressure which is connected by said bore hole with space of said fuel tank.

* * * * *